United States Patent [19]

Anello

[11] Patent Number: 4,495,002

[45] Date of Patent: Jan. 22, 1985

[54] THREE-STEP TREATMENT OF STAINLESS STEELS HAVING METASTABLE AUSTENITIC AND MARTENSITIC PHASES TO INCREASE RESISTANCE TO CHLORIDE CORROSION

[75] Inventor: Joseph G. Anello, Ridley Park, Pa.

[73] Assignee: Westinghouse Electric Corp., Pittsburgh, Pa.

[21] Appl. No.: 487,485

[22] Filed: Apr. 22, 1983

Related U.S. Application Data

[63] Continuation of Ser. No. 267,826, May 27, 1981, abandoned.

[51] Int. Cl.[3] ..... C21D 7/06

[52] U.S. Cl. ..... 148/12 E; 148/12.3; 148/39

[58] Field of Search ..... 148/12 E, 12.3, 38, 148/136, 39; 29/DIG. 36; 72/53

[56] References Cited

U.S. PATENT DOCUMENTS

| | | | |
|---|---|---|---|
| 2,920,007 | 1/1960 | Buckland | 148/38 |
| 3,073,022 | 1/1963 | Bush et al. | 72/53 |
| 3,357,458 | 12/1967 | Radd et al. | 72/53 |
| 3,505,130 | 4/1970 | Paul | 148/39 |
| 3,730,785 | 5/1973 | Conrad, Sr. et al. | 148/39 |
| 3,844,846 | 10/1974 | Friske et al. | 148/12.3 |
| 4,086,104 | 4/1978 | Kinoshita et al. | 148/38 |

FOREIGN PATENT DOCUMENTS

| | | | |
|---|---|---|---|
| 41617 | 11/1978 | Japan | 148/12 E |
| 711126 | 2/1980 | U.S.S.R. | 148/12.3 |

OTHER PUBLICATIONS

Shot Peening, American Wheelabrator & Equipment Corp., Mishawaka, Indiana, 1946, p. 15.

Shot Peening, The Wheelabrator Corporation, Mishawaka, Indiana, 1965, Eighth Edition, pp. 3, 34–37, 54, 130–133.

*Primary Examiner*—Peter K. Skiff

*Attorney, Agent, or Firm*—John J. Prizzi; Richard A. Stoltz

[57] ABSTRACT

This is a process for producing improved chloride corrosion resistance in turbine components fabricated from stainless steels which contains generally at least 1% of both a martensitic and metastable austenitic phase and comprises an initial high-intensity shot peening, followed by an aging cycle at about 980°–1020° F. for ¼–4 hours and a final (lower intensity) shot peening.

A relatively homogeneous surface of aged martensite is produced and selective attack which forms sharp pit-like defects which initiate cracks is avoided.

12 Claims, 7 Drawing Figures

THREE-STEP TREATMENT OF STAINLESS STEELS HAVING METASTABLE AUSTENITIC AND MARTENSITIC PHASES TO INCREASE RESISTANCE TO CHLORIDE CORROSION

This is a continuation of application Ser. No. 267,826, filed May 27, 1981, now abandoned.

BACKGROUND OF THE INVENTION

This invention relates to a technique for treating stainless steel to reduce corrosion, and more particularly to stainless steels which contain both a martensitic and metastable austenitic phase, such as 17-4 PH (AISI 630 modified) or AISI type 301.

Before the development of this technique, chlorine induced corrosion assisted cracking was a very significant problem. In steam turbines, for example, chlorine ion environments had cause a large number of blade cracking incidents resulting in significant turbine downtime.

SUMMARY OF THE INVENTION

A three-step special surface treatment of stainless steel blades which contain both martensitic and austenitic phases has been developed to enhance corrosion resistance. The enhanced corrosion resistance is provided at the surface by first shot peening the surface at a high intensity to transform most of the austenite at the surface to untempered martensite; then a heat treatment is performed to convert the surface to largely all tempered martensitic; and finally the component surface is again shot peened, but at a lower intensity than in the initial step.

An embodiment of this process comprises an initial shot peening of the fabricated turbine component at an intensity of 0.010–0.015 A with 190–270 size shot. The shot peened component is then heat-treated at 980°–1020° F. for ¼–4 hours. The heat-treated component is then given a final shot peening at an intensity of 0.004–0.006 A with 70–150 size shot.

BRIEF DESCRIPTION OF THE DRAWINGS

A better understanding of the invention may be had by reference to the drawings, in which.

DESCRIPTION OF THE PREFERRED EMBODIMENTS

It has been found that stainless steel, which contains both martensitic and austenitic phases, have experienced pitting/cracking due to selective corrosion of the aged martensite (as opposed to equal attack on the three phases present in the microstructure's aged and unaged martensite, and austenite) when exposed to chloride ion bearing turbine environments. The selective nature of the attack results in increased sensitivity to crack initiation due to the sharp pit-like defects that are formed. Cracks propagate to such a depth that normal blade operating stresses, for example, can cause high cycle fatigue cracking and subsequent blade failure.

Figure 1:
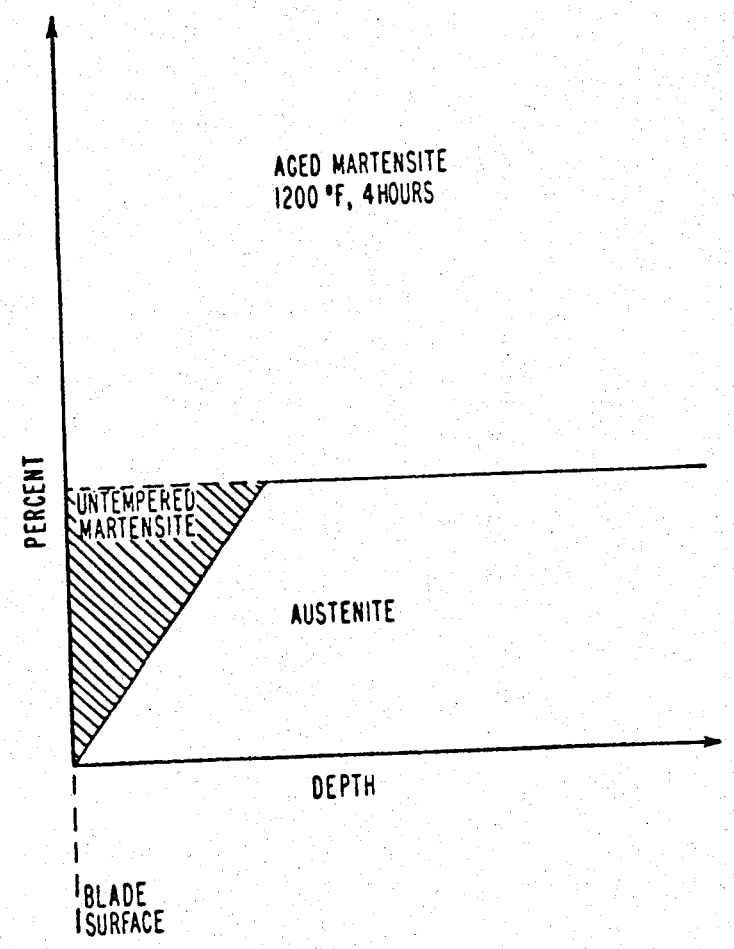
FIG. 1 is a graph indicating the relative percent of aged martensite, untempered martensite, and austenite as a function of depth after conventional treatment (shot peening at 0.004–0.006 A intensity)

As can be seen from FIG. 1, the normal shot peening at 0.004–006 A intensity changes most of the austenite at or near the surface to untempered (unaged) martensite (which, like the austenite, is not as rapidly attacked as the aged martensite which, for example, constitutes about 75 percent of the material in a 17–4 PH material). The untempered martensite in the surface layers is produced by strain transformation of austenite to untempered martensite and varying the intensity of the shot peening will vary the depth of austenite transformed.

To avoid the selective chloride attack on portions of the surface and the sharp pit-like defects which initiate cracks, the surface is converted by the process of this invention to largely all (over 95%) tempered (aged) martensite such that the corrosion occurs relatively uniformly over the entire surface (avoiding phase selective pitting and cracking).

Figure 2:
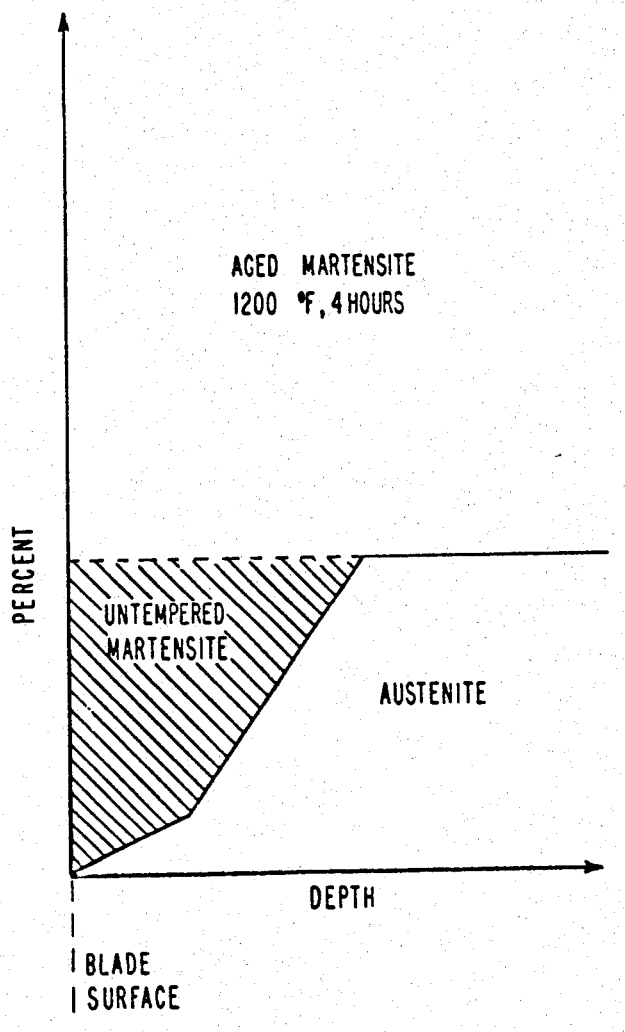
FIG. 2 is a similar graph of percent of the phases versus depth, but after the initial shot peening step of this invention.

A three-step special surface treatment is used. In the first step, the fabricated component (e.g. finished steam turbine blade) is high intensity shot peened all over (0.010–0.015 A intensity, 230 shot size, 125–300% coverage) to strain transform austenite (present in the microstructure at typically 15–35%) to unaged martensite to produce a low amount of austenite in the surface layer (to a depth of 3–5 mils). The results of this shot peening are shown schematically in FIG. 2.

Figure 3:
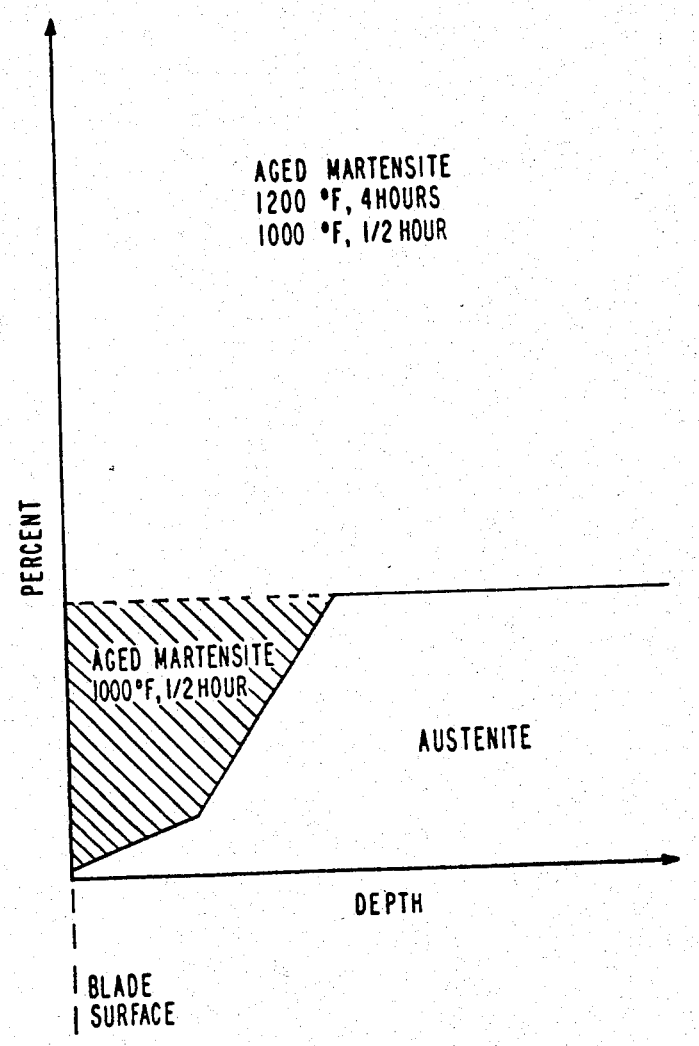
FIG. 3 is a similar graph of percent of the phases versus depth after the second (heating) step of this invention.

In the second step, the component is heat-treated (980°–1020° F. for ¼–4 hours) to age the material which had been transformed into unaged martensite (FIG. 3) to cause primarily diffusion of nickel to the copper precipitate reducing the nickel in solution in the prior austenite and now aged martensite phase (austenite and untempered martensite are primarily nickel rich relative to the aged martensite). The resulting chemically homogeneous phases in the metal surface layer enhance corrosion resistance.

Figure 3A:
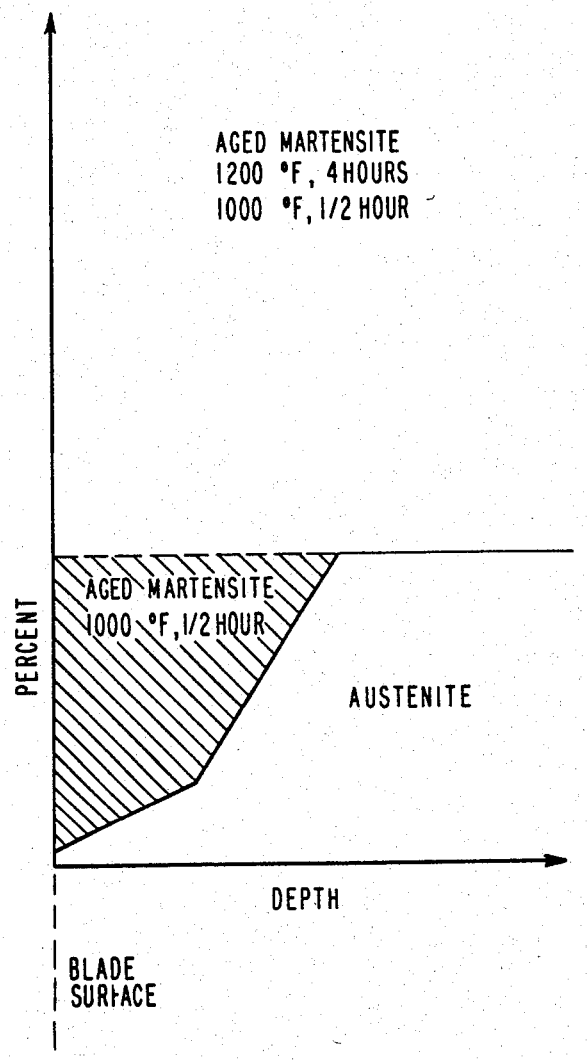
FIG. 3A is a similar graph of percent of phases versus depth after the final shot peening step of this invention.

In the third step, the component is shot peened at lower intensity (0.004–0.006 A to regain the compressive layer) which contributes to corrosion resistance and fatigue strength benefits (FIG. 3A).

Figure 3B:
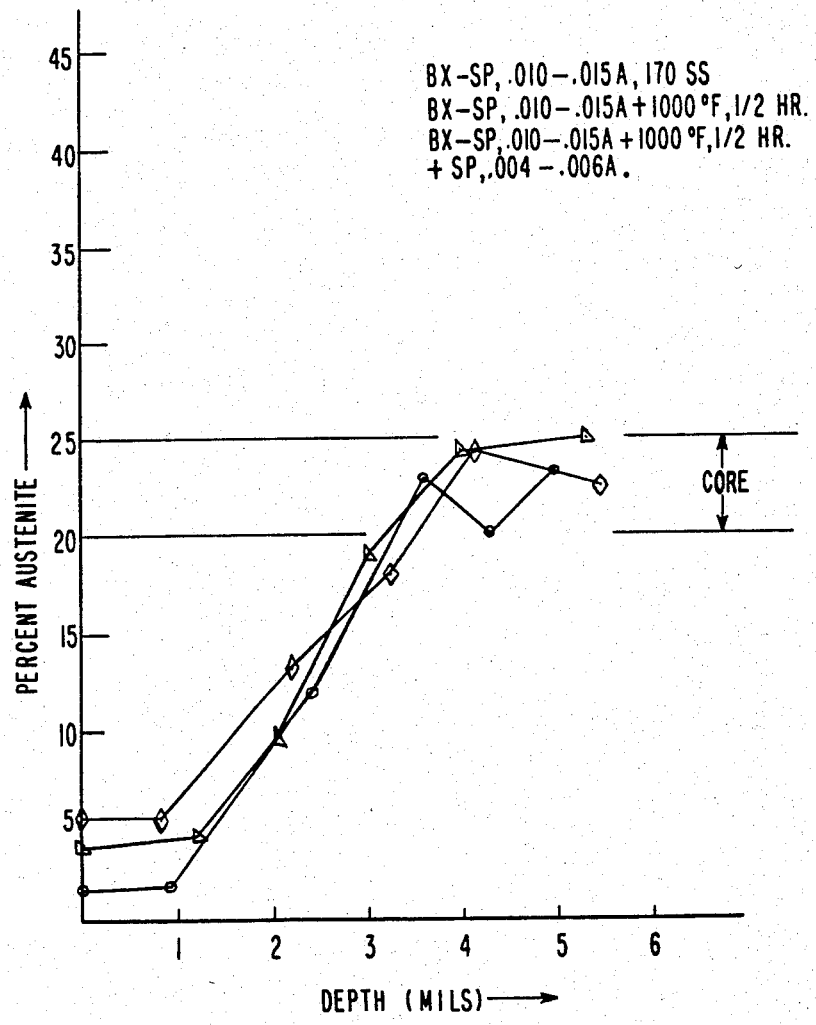
FIG. 3B shows the percent austenite versus depth for a 17–4 ph stainless steel.

The measured percent of austenite in a 17–4 ph steel as a function of depth after each of the three stages of the present invention is shown in FIG. 3B.

Figure 4A:
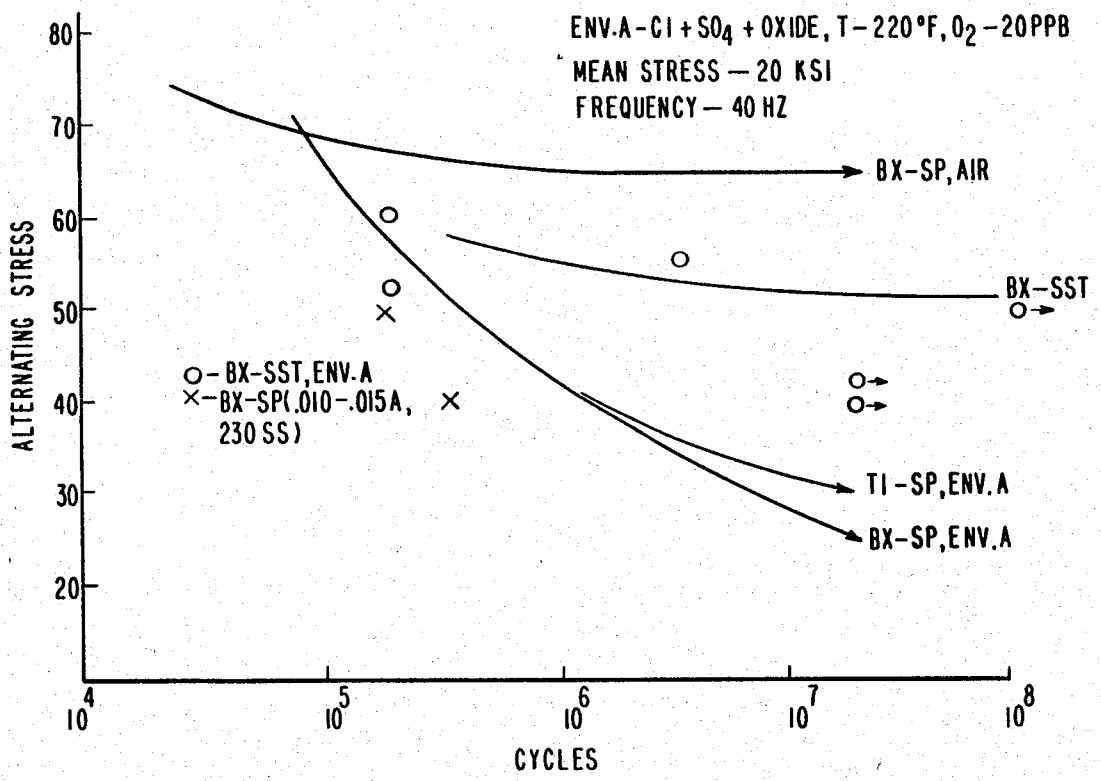
FIG. 4A shows the fatigue strength of plain bar axial fatigue specimens tested in a chloride ion containing fatigue environment relative to fatigue strength in air.
Figure 4B:
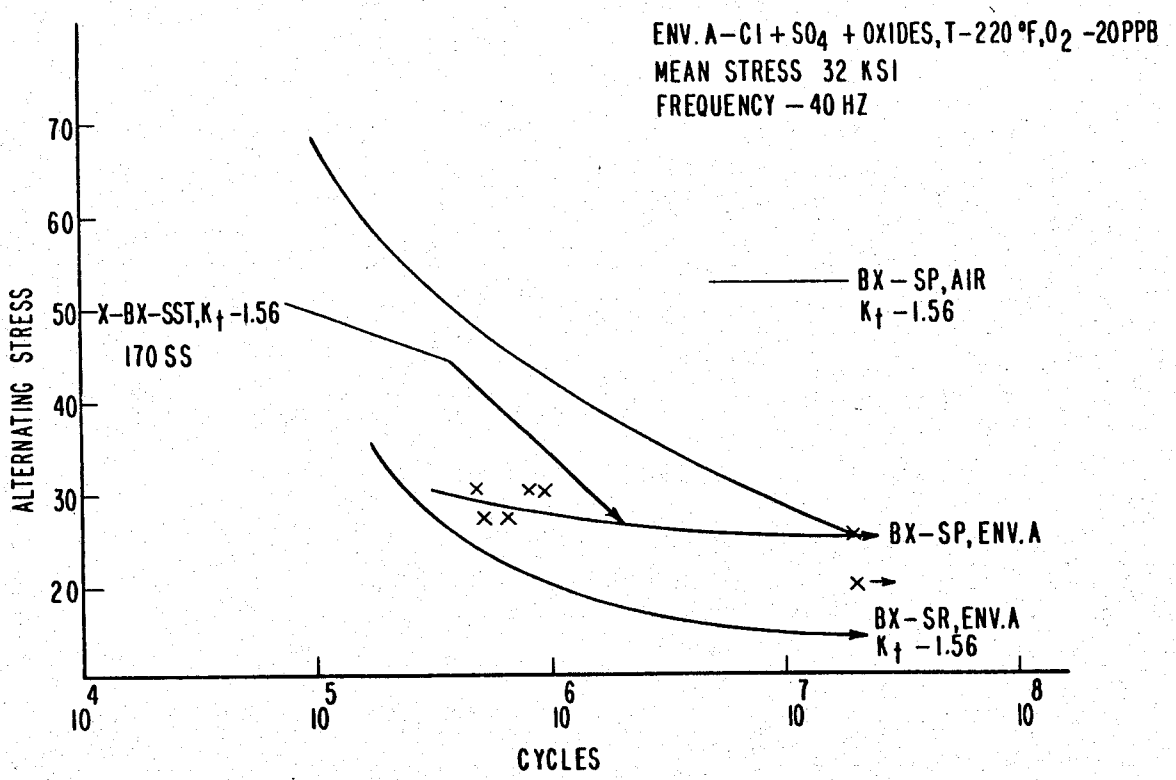
FIG. 4B shows notched fatigue properties of various specimens under the same chloride and air environments.

Test specimens were exposed to a chloride ion containing fatigue testing environment (24% sodium chloride, 4.5% $Na_2SO_4$ solution boiling at 225° F., deaerated to 20 ppd $O_2$ at a pH of 7.5–8.5) to evaluate the results. As indicated in FIG. 4A, the treatment of this invention, SST, provides a more than two times increase in fatigue strength when compared to the conventional treatment SP, (both sets of specimens tested in the aforementioned fatigue environment). As can be seen from FIG. 4B, the notched fatigue properties of the treated material in the environment is equivalent to the standard material properties in the unnotched condition.

As can be seen from Table I below, test results for slow strain rate testing also suggests some improvement.

TABLE I

| SPECIMEN PREPARATION | ENV. | SLOW STRAIN RATE TEST SUMMARY UTS (KSI) | Y.S. (KSI) | EL (%) | R.A. (%) |
|---|---|---|---|---|---|
| BX-SP (BASE-LINE) | AIR, R.T. | 142 | 99 | 15.6 | 69.9 |
| | "A" | 115 | 103 | 6.0 | 19.6 |
| $SP_I$ - .010–.015A, 170SS 1000° F., ½ HR. | "A" | 115 | 112 | 8 | 43.0 |
| $SP_F$ - .004–.006A, 110SS SAME AS ABOVE, 1000° F., 20 HRS. | "A" | 123 | 120 | 10 | 30.1 |
| $SP_I$ - .010–.015A, 230SS 1000° F., ½ HR. | "A" | 124 | 118 | 11 | 34.0 |
| $SP_F$ - .004–.006A, 110SS SAME AS ABOVE, 1000° F., 20 HRS. | "A" | 127 | 123 | 8 | 37.0 |

ENV.A-6 gms $Na_2SO_4$ + 33 gms NaCl + Oxide Mixture "K", boiling (220° F.) $O_2$ 20 ppb
$SP_I$ - INITIAL SHOT PEENING
$SP_F$ - FINAL SHOT PEENING The initial high intensity shot peening is done at an intensity of 0.010–0.015 A (and preferably 0.010–0.012 A) with a shot size of 190–270 (preferably 210–250 and typically 230) and preferably with about 150% coverage. The heating is preferably done to 990°–1000° F. for about ½ to 2 hours. The final shot peening is done at an intensity of 0.004–0.006 A with 70–150 shot size (preferably 90–130 and typically 110 shot size) and preferably with 150% coverage).

What is claimed is:

1. A process for producing improved chloride corrosion resistance in turbine components fabricated from stainless steel which contains both aged martensitic and metastable austenitic phases, said process comprising:

(a) initial shot peening said fabricated component at an intensity of 0.010–0.015 A with 190–270 size shot;

(b) heating said component to about 980°–1020° F. for ¼–4 hours; and (c) final shot peening said component at an intensity of 0.004–0.006 A with 70–150 size shot.

2. The process of claim 1, wherein said component is heated to 990°–1000° F. for ½ to 2 hours.

3. The process of claim 2, wherein 125–300% coverage is provided during both shot peenings.

4. The process of claim 3, wherein the initial shot peening is at an 0.010–0.012 A intensity with 210–250 size shot, with about 150% coverage.

5. The process of claim 4, wherein the final shot peening is with 90–130 size shot, with about 150% coverage.

6. The process according to claim 1 wherein said stainless steel further contains precipitates formed by aging.

7. The process according to claim 1 wherein said stainless steel is a 17–4 PH stainless steel.

8. The process according to claim 6 wherein said precipitates contain copper.

9. A process for producing improved chloride corrosion resistance in turbine components fabricated from stainless steel which has a surface containing both aged martensitic and metastable austenitic phases, said process comprising:

(a) initial high-intensity shot peening of said surface of said component transforming most of said metastable austenite at said surface to martensite;

(b) then heat treating to convert said surface to largely all aged martensite;

(c) and then shot peening said surface at a lower intensity than in said initial high intensity shot peening step.

10. The process according to claim 9 wherein said stainless steel surface further contains precipitates formed by aging; and after the final shot peening step said stainless steel surface is characterized by said aged martensitic phase, and precipitates containing copper.

11. The process according to claim 10 wherein said stainless steel is 17–4 PH stainless.

12. The process according to claim 10 wherein after said final shot peening step said stainless steel surface is further characterized by a low amount of austenitic phase.

* * * * *